United States Patent [19]

Mimura et al.

[11] Patent Number: 4,537,846

[45] Date of Patent: Aug. 27, 1985

[54] MULTICONDUCTIVE LAYER ELECTROPHOTOGRAPHIC PHOTOSENSITIVE DEVICE AND METHOD OF MANUFACTURE THEREOF

[75] Inventors: Yoshiyuki Mimura; Takao Okada; Akitoshi Toda, all of Hachioji, Japan

[73] Assignee: Olympus Optical Company, Ltd., Japan

[21] Appl. No.: 543,285

[22] Filed: Oct. 19, 1983

[30] Foreign Application Priority Data

Oct. 20, 1982 [JP] Japan ..... 57-184192

[51] Int. Cl.[3] ..... G03G 5/14

[52] U.S. Cl. ..... 430/58; 430/63; 430/67; 430/85; 430/131; 430/69

[58] Field of Search ..... 430/58, 69, 84, 67, 430/63, 131, 85

[56] References Cited

U.S. PATENT DOCUMENTS

| | | | |
|---|---|---|---|
| 3,679,418 | 7/1972 | Stroszynski | 430/69 |
| 4,081,273 | 3/1978 | Goffe | 430/41 |
| 4,134,763 | 1/1979 | Fujimura et al. | 430/69 |

FOREIGN PATENT DOCUMENTS 2055269 7/1982 Fed. Rep. of Germany .

*Primary Examiner*—John Goodrow

*Attorney, Agent, or Firm*—Ostrolenk, Faber, Gerb & Soffen

[57] ABSTRACT

In an electrophotographic photosensitive device including a conductive layer, a selenium based photoconductive layer and a transparent insulating layer which are sequentially laminated, the conductive layer is formed of an aluminum substrate conductive layer, a zinc conductive layer a copper conductive layer, and silver conductive layer which are sequentially laminated to each other. As a result of this structure, the charge injection characteristic of the photosensitive device during primary charging is improved, and the charge injection preventing characteristic during the simultaneous secondary charging and image exposure steps is sufficiently maintained. The conductive layers contact each other intimately. The electrophotographic photosensitive device is highly humidity durable and exhibits a long life and can obtain high electrostatic contrast.

10 Claims, 2 Drawing Figures

MULTICONDUCTIVE LAYER ELECTROPHOTOGRAPHIC PHOTOSENSITIVE DEVICE AND METHOD OF MANUFACTURE THEREOF

BACKGROUND OF THE INVENTION

The present invention relates to an electrophotographic photosensitive device essentially composed of a conductive layer, a photoconductive layer and a transparent insulating layer for an electrophotographic copying machine, and to a method of manufacture thereof.

For the purpose of obtaining an electrostatic latent image, there is already known and commercially employed an electrophotographic process using a photosensitive device essentially consisting of a conductive layer, a photoconductive layer and a transparent insulating layer and comprising for example a primary charging step for subjecting the surface of the photosensitive device to a uniform charging of a predetermined polarity, an image exposure step for exposing the surface to a light image, a secondary charging step for applying, simultaneously with the image exposure, an AC corona discharge or DC corona discharge of opposite polarity, and a whole surface exposure step.

One such photosensitive device is formed using aluminium as the conductive layer, selenium as the photoconductive layer and polyethylene terephthalate (PET) as the insulating layer. Since the selenium based photoconductive layer is a P-type material, it is not possible to form electric charge pairs across the insulating layer during the above-mentioned primary charging step of the electrostatic latent image forming process. Therefore, an electrostatic latent image of sufficiently high electrostatic contrast can not be obtained.

Particularly, during the primary charging step, since the dark resistance of the selenium photoconductive layer is high and the injection of carrier from conductive layer side is relatively low, the result is far from the ideal state of forming electric charge pairs only across the insulating layer. Consequently, the intensity of the charging effect of the primary charging is decreased, and the contrast between the bright portions and the dark portions depends only on the simultaneous secondary charging and image exposure steps. When the secondary charging is performed by AC corona charging, substantially no contrast is obtained, and when the secondary charging is DC corona charging of opposite polarity, only a very low contrast can be obtained.

To improve the contrast, an auxiliary method has been proposed wherein the simultaneous secondary charging and image exposure steps are performed after the primary charging step and simultaneously with the whole surface exposure steps or after both the primary charging and whole surface exposure steps. While the contrast obtained by the auxiliary method is improved, it is necessary to add a whole surface exposure lamp to use in whole surface exposure step and the apparatus is, therefore, more complicated. Further, a contrast which is sufficient for practical purposes still cannot be obtained, and in high speed processes, such auxiliary method can not improve the problem.

The prior art has also utilized a photoconductive layer formed by powdered material, e.g. ZnO or CdS, which is scattered in resin binder in the photosensitive device to obtain a high contrast. However, such a photosensitive device involves problem of humidity durability.

SUMMARY OF THE INVENTION

The primary object of the present invention is to provide an electrophotographic photosensitive device of high humidity resistance and long life and which can obtain high electrostatic contrast, and a method of manufacture thereof.

The other subject of the present invention is to provide an electrophotographic photosensitive device which can obtain uniform and stable electrostatic latent image and a method of manufacture thereof.

Further object of the present invention is to provide a method of manufacturing electrophotographic photosensitive device to easily form conductive layer having improved charge injection characteristic and intimate contact property.

To attain the above mentioned objects, the electrophotographic photosensitive device according to the invention comprises an aluminium substrate conductive layer, a Zn conductive layer or a Zn conductive layer and a Cu conductive layer, a Ag conductive layer, a Se based photoconductive layer and a transparent insulating layer which are sequentially laminated.

The method of manufacturing a electrophotographic photosensitive device, according to the present invention, comprises the steps of: forming a Zn conductive layer on a Al substrate conductive layer by a substitution method or an electroplating method, forming a Cu conductive layer and a Ag conductive layer or a Ag conductive layer on the Zn conductive layer by an electroplating method, forming a Se based photoconductive layer on the Ag conductive layer by an evaporation method, and forming a transparent insulating layer on the photoconductive layer.

By the above mentioned construction, according to the present invention, the charge injection characteristic during the primary charging step is improved and the charge injection preventing characteristic during the simultaneous secondary charging and image exposure steps is sufficiently maintained so that high electrostatic contrast and high humidity durable photosensitive device can be obtained. The Ag conductive layer contacts intimately with the Al substrate conductive layer so that electrostatic latent image obtained by the photosensitive device is uniform and stable.

The objects and advantages of the present invention are hereinafter set forth and explained with respect to the accompanying drawings.

DESCRIPTION OF PREFERRED EMBODIMENTS

Figure 1:
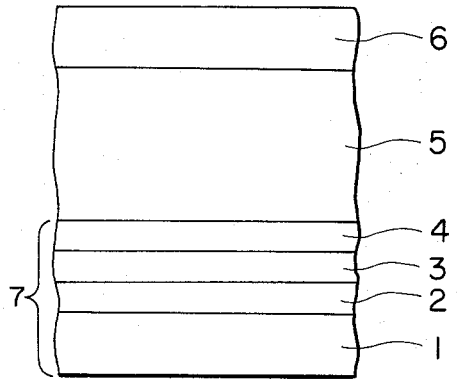
FIG. 1 and FIG. 2 are enlarged cross sectional views of portions of two embodiments of the electrophotographic photosensitive device, according to the present invention.

Referring now to FIG. 1, the electrophotographic photosensitive device, according to the present invention is formed by a Al substrate conductive layer 1, a Zn conductive layer 2, a Cu conductive layer 3, a Ag conductive layer 4, a Se based photoconductive layer 5, and a transparent insulating layer 6 which are sequentially laminated to one another.

The Al substrate conductive layer is known to be the most suitable conductive substrate for such a photosensitive device in view of its machinability, hardness, cost and surface properties, so that the photosensitive device according to the present invention, also utilizes the Al substrate conductive layer.

If the Se based photoconductive layer 5 is directly formed on the Al substrate conductive layer 1, as in known devices, the charge injection characteristic from the Al conductive layer 1 to the photoconductive layer 5 during the primary charging is insufficient. To overcome this problem, an Ag conductive layer 4 is inserted between the Al substrate 1 and the Se based photoconductive layer 5. To attain this result, the Ag conductive layer 4 may be coated directly on the Al substrate conductive layer 4. However, when Ag layer 1 is formed on the Al layer by evaporation, the contact force between the layers is not sufficient, and it is difficult to form the layer 4 more than a few micrometer in depth. When the Ag conductive layer 4 is directly coated on the Al substrate layer 1 by an electroplating method, the silver can not be coated uniformly, contact force between the layers is weak, brightness is insufficient and durability is low. Thus, according to the present invention, at least a Zn conductive layer 2 is inserted between the Ag conductive layer 4 and the Al substrate conductive layer 1. In the embodiment shown in FIG. 1, to adhere the Ag conductive layer 4 more intimately, the Cu conductive layer 3 is formed on the Zn conductive layer 2, and the Ag conductive layer 4 is formed on the Cu conductive layer 3.

In this case, the thickness of the inserted Zn conductive layer 2 is between 0.1–10 μm, preferably about 1 μm. The Zn layer may be formed by electroplating or may be formed by immersion in a substitution liquid. The thickness of the Cu conductive layer is between 1–50 μm, preferably about 10–15 μm. The Cu layer may be formed by electroplating utilizing a Cu Cn solution.

The thickness of the Ag conductive layer 4 which is formed on the 2 conductive layer Zn or on the Cu conductive layer 3 is between 0.5–50 μm, preferably about 5 μm. The Ag layer 4 may be formed by electroplating. In this case, preferable compositions of plating solution are a solution of silver cyanide, calcium cyanide and potassium carbonate, and a solution of potassium argenticyanide, potassium cyanide and potassium carbonate. Preferably, the plating temperature is between 10°–30° C., current density is between 0.1–2 $A/dm^2$ and the pH is greater than 9, to form the silver conductive layer 4.

Thus plated the Zn, Cu and Ag conductive layers 2–4 and the Al substrate conductive layer 1 form an intimately contacted conductive layer 7 and charge injection to the photoconductive layer 5 from the conductive layer 7 is sufficient. It is believed that the reason for the improved intimate contact between layers is the compatibility between adjacent materials at the interface of conductive layers.

Also, the Zn, Cu and Ag conductive layers have a uniform bright surface as compared with Ag conductive layer surface directly formed on the Al substrate conductive layer 1. Further, the Zn, Cu and Ag conductive layers according to the present invention are superior with respect to cost, machinability, hardness and surface smoothness when compared with an Ag conductive layer 4 directly plated on the Al conductive layer 1 to a thickness equal to the total of the three layers 2–4.

The transparent insulating layer 6 is formed on the photoconductive layer 5 by a suitable method to a thickness of about 5–40 μm. The insulating layer 6 is selected from materials which are transparent to visible light and has high specific resistance, e.g. more than $10^{14}\Omega\cdot$ cm. Examples of such materials are: polyethylene terephthalate, paraxyliren and acryl-, epoxi-, urethane-, fluor-, stylene- and carbonateresin.

The photoconductive layer 5 is formed on the Ag conductive layer 4 by evaporation and consists of selenium only or selenium doped with Te, As, Ge, S, Sb or halogen.

Figure 2:
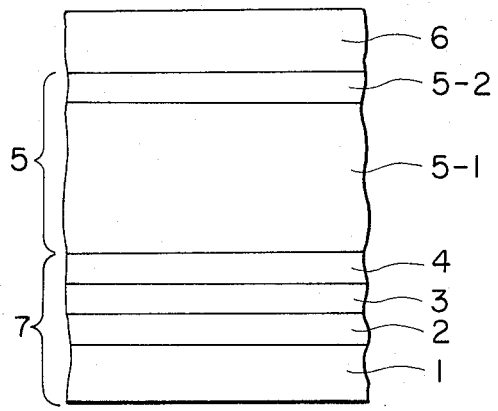

In the embodiment shown in FIG. 1, the selenium based photoconductive layer 5 is formed as single layer. In the embodiment shown in FIG. 2, the photoconductive layer 5 is formed by two layers, i.e. a selenium based charge transport layer 5-1 consisting of pure selenium or halogen doped selenium and a charge generation layer 5-2 based on Se and Te alloy. In FIG. 2, same reference numeral shows same or similar portion to that of FIG. 1.

As is well known, to obtain high contrast in an electrostatic latent image, charge which is injected from the conductive layer 4 during the primary charging step should transport rapidly through the photoconductive layer 5 without being blocked, to be captured sufficiently under the transparent insulating layer 6. In the electrophotographic process, the selenium based photoconductive layer decreases mobility when the photoconductive layer 5 is doped with an impurity, other than halogen, even to a small degree. For example, it is not preferable for the layer 5 to contain tellurium as an impurity with respect to its effect on charge mobility. On the other hand, when the photo-conductive layer is formed only of selenium, the photosensitive range of the layers is limited to a short wave range of visible rays during the simultaneous secondary charging and image exposure steps followed by the whole surface exposure step, so that photosensitive efficiency is low. To improve the photosensitive range and the overall efficiency, the layer 5 must be doped with tellurium or arsenic.

The embodiment shown in FIG. 2 comprises a two layered photoconductive layer 5 to simultaneously satisfy the two above mentioned demands (high charge mobility and high photosensitive efficiency). More particularly, under the transparent insulating layer 6, a charge generating layer 5-2 is formed and mainly consists of selenium and tellurium. The layer 5-2 is formed thin enough to prevent mobility from decreasing, but increases the sensible wave length range and photosensibility layer 5, so that efficiency during the simultaneous charging and image exposure steps and subsequent whole surface exposure step is increased. A charge transport layer 5-1 which is formed by selenium only or halogen of 0–4000 ppm doped selenium and has large mobility is formed so that transport of charge which is injected from the Ag conductive layer 4 during the primary charging step is easy, and increased sensitivity during the primary charging is sufficiently obtained.

The construction of the photoconductive layer 5 formed by the two layers is described in detail. The charge transport layer 5-1 consists of halogen doped selenium in which the halogen e.g. chlorine is 0–4000 ppm and the selenium is high purity more than 99,999%. The charge transport layer 5-1 is formed by a vacuum evaporation process on the Ag conductive layer 4 to a thickness of about 20–70 μm. The charge generating layer 5-2 consists of selenium tellurium alloy in which tellurium content is 5–25%, and is formed by a vacuum evaporation process on the charge transport layer 5-1 to a thickness of 0.05–5 μm. The selenium tellurium alloy may be doped by arsenic, silicon, antimony or halogen to prevent crystallization, to increase sensitivity and to remove residual charge.

When the vacuum evaporation process is performed, the temperature of the substrate layer 1 and the conductive layers 2-4 is maintained at 55°–65° C. When the vacuum evaporation temperature is below 55° C., the residual potential is high, process response speed is low, and sufficient image contrast may not be obtained. When the vacuum evaporation temperature is more than 65° C., the resistance of the photoconductive layer is substantially decreased so that the charge injection and transport effect from the Ag conductive layer 4 are superior, however, charge injection and transport from the Ag conductive layer 4 are performed during the simultaneous charging and image exposure steps disregarding the bright portion and the dark portion so that desired contrast of the image can not be obtained. Thus, the substrate temperature during evaporation process should be set as above.

The embodiment shown in FIG. 2, in which selenium based photoconductive layer 5 is formed into two layered construction of the charge generating layer 5-2 and the charge transport layer 5-1 has been described in detail and the functions of the two layers to obtain the desired high contrast has been explained. The function of the Al, Zn, Cu and Ag conductive layers to obtain high image contrast will now be explained.

An important feature of the conductive layer 7 is that it enables sufficiently good charge injection during the primary charging step, and as low as possible charge injection during the simultaneous secondary charging and image exposure steps in order to obtain a desirable contrast between bright and dark portions. To this end, the material of the conductive layer 7 must be matched with that of the photoconductive layer 5 in accordance with the process.

The Al, Zn, Cu and Ag conductive layer of the photosensitive device according to the present invention is compared with the conventional Al conductive layer in the following experiments.

A conventional Se based photosensitive device having an Al conductive layer and a Se based photosensitive device having Al, Zn, Cu and Ag conductive layers according to the present invention were prepared, and subjected to corona charging of −2000 V in darkness and then to a strong whole surface exposure. The potential drop was measured, and the value was about 1000 V in the conventional photosensitive device and was only about 250 V in the photosensitive device according to the present invention.

From this result it is clear that in the photosensitive device having Al, Zu, Cu and Ag conductive layers charge is injected from the conductive layer 7 by charging of −2000 V in darkness and effective charge pairs corresponding to −1750 V are formed across the insulating layer 6 when the whole surface exposure step is initiated. In the conventional photosensitive device having Al conductive layer, potential of about −1000 V is distributed to the photoconductive layer which is about half of −2000 V charging potential, and charge pairs corresponding to −1000 V are formed across the insulating layer. This means that conventional Al conductive layer has very poor charge injection characteristic compared with the conductive layers according to the present invention.

Next, the secondary charging +2000 V positive corona charging was applied to both photosensitive devices and potential change was measured. The measured potential change was about 1150 V in both devices.

From the experiments described above, the photosensitive device according to the present invention provides superior charge injection characteristic during the primary charging step as compared with the conventional photosensitive device, and has charge injection preventing characteristic during the secondary charging step which is similar to that of the conventional photosensitive device, so that an electrostatic latent image of high contrast can be obtained.

In the photosensitive device, according to the present invention, physical property factors governing charge injection at the interface between the Al, Zn, Cu and Ag conductive layers and the Se based photoconductive layer can be considered as follows; the detailed reasons that these physical properties govern charge injection not being clear.

(1) Physical and chemical surface conditions of the conductive layer.

(2) Density of recombination center of the Se based photoconductive layer 5 at the interface.

(3) Barrier formability based on the difference of work function between the Se based photoconductive layer 5 and the conductive layer 7.

(4) Barrier formability based on difference of the work functions between the Al, Zn, Cu and Ag layers.

The method for manufacture of the above described electrophotographic photosensitive device, according to the present invention, will be described in detail by the following examples.

EXAMPLE 1

An aluminium drum after fat removing treatment was dipped in alkali solution of NaOH: 525 g/l and ZnO: 100 g/l, for 1 minute to remove surface oxide skin, and a Zn layer of about 1 μm thickness was formed on the surface by a substitution process. On the surface of the Zn layer, a solution of CuCN: 41.3 g/l, NaCN: 48.8 g/l, $Na_2CO_3$: 30.0 g/l, Rochelle salt: 60.0 g/l, pH: 10.3, temperature: 40° C. was used to electroplate a Cu layer of 10 μm thickness. The electroplating process was carried out for 15 minutes. The reason for Cu plating is that, Ag plating directly on the Zn layer is unstable and insufficient contact is likely to occur.

The Cu plated drum was dipped in a solution of silver cyanide: 26.25 g/l, calcium cyanide: 52.59 g/l, potassium carbonate: 37.5 g/l, pH: 10.5, temperature 20° C., and Ag was plated at a current density of 1.8 $A/dm^2$ for 5 min. to form an Ag layer about 5 mm in thickness on the Cu layer. The device was washed and dried, and heated to 60° C. A Se layer having a purity of 99.999% was vacuum evaporated to a thickness of 50 μm on the Ag layer, and a Se Te alloy containing 10% Te was vacuum evaporated to a thickness of 0.5 μm to form a Se based photoconductive layer. On the photoconductive layer, a PET film having a thickness of 20 μm was adhered to form a transparent insulating layer thereby completing a photosensitive device according to the referred embodiment of the present invention.

The manufactured photosensitive device was charged to −2000 V using a scorotron charger for primary charging. Thereafter, the simultaneous corona charging of 6.5 KV and image exposure steps and the subsequent whole surface exposure step were performed to obtain an electrostatic latent image.

The second sample of the device, after similar primary charging, was subjected to +6.5 KV DC positive corona charging and simultaneous image exposure steps, and whole surface exposure step to obtain an electrostatic latent image.

The contrast potentials Vc obtained by the two methods are shown in the AC and DC columns of Table 1 (below) and are 420 V and 540 V, respectively. The electrostatic latent image was developed by the magnetic brush method and copied on paper. Superior copy image of high contrast was obtained.

Afterwards, charges were eliminated from the surface of the photosensitive device and the copy process was repeated. Rdesidual potential and residual image did not appear and a superior image was obtained. Furthermore, the copy process was repeated, and the contrast potential after 50000 cycles was about 95% of its initial value, and proved a superior service life.

To inspect humidity durability, the photosensitive device was subjected to 85% relative humidity for three days and the above experiment was repeated. The contrast potential showed no essential change.

EXAMPLE 2

An aluminium drum was subjected to a fat removing treatment and was the dipped in a zinc plating solution of ZnCN: 60 g/l, NaCN: 42 g/l, NaOH: 78.8 g/l, to electroplate a zinc layer having a thickness of 2 μm. Then, as in Example 1, a Cu layer having a thickness of 5 μm and an Ag layer having a thickness of 5 μm were plated in order, to form conductive layer formed by Al, Zn, Cu and Ag layers. Maintaining the conductive layer at a temperature of 57° C., selenium containing 15 ppm of chlorine was vacuum evaporated to a thickness of 45 μm on the conductive layer, then a selenium tellurium alloy containing 15% Te and 1.5% As was vacuum evaporated to a thickness of 1 μm to form a two layered photoconductive layer. On the photoconductive layer, paraxyliren resin was vapor evaporated to a thickness of 24μ to form insulation layer to form the photosensitive device, according to the present invention.

The photosensitive device was evaluated under similar conditions to those described in Example 1. The contrast potentials are shown in the Table 1, and are sufficient to obtain the desired image. The humidity resistant characteristic and service life are also sufficient.

EXAMPLE 3

An aluminium drum, after pre-treatment including a fat removing process, was dipped in the zinc plating solution described in Example 2 to plate a Zn layer having a thickness of 2 μm on the surface of the aluminium drum, an Ag layer having a thickness of 5 μm was plated onto the Zn layer as described in Example 1. Then the conductive layer was heated to maintain a temperature of 57° C., and selenium containing 15 ppm chlorine was vacuum evaporated to a thickness of 45 μm. Further on the Se layer, a Se Te alloy containing 15% Te and 1.5% As was vacuum evaporated to a thickness of 1μm to form a two layered photoconductive layer. On the photoconductive layer a paraxyliren layer was vapor evaporated to a thickness of 25 μm to form a photosensitive device according to a preferred embodiment of the present invention.

The photosensitive device was evaluated by under the same conditions described in Example 1. The measured contrast potentials are shown in the Table 1 and are sufficient to form a desired image. The humidity resistant characteristic is also superior. As to the service life measured after 50000 cycles, the value is practically serviceable and is better than coonventional device described in Reference 2 in Table 1.

REFERENCE 1

On a pretreated aluminium drum, selenium of having a 99.999% purity was directly vacuum evaporated to a thickness of 50 μm and a Se Te alloy containing 10% Te was vacuum evaporated to form a two layered photoconductive layer. On the photoconductive layer a transparent film of thickness 20 μm was adhered. Thus, a reference sample to evaluate the conductive layer was obtained. The photoconductive layer having a two layered construction in Reference 1 is provided to eliminate the effect of the photoconductive layer.

The photosensitive device was evaluated as Example 1. The measured contrast potentials are shown in Table 1, and are very low compared with those of Examples 1 and 2. The result means that the conductive layer formed as Al, Zn, Cu and Ag layers, according to the invention is superior compared with conventional Al conductive layer.

EXAMPLE 4

On the conductive layer formed by Al, Zn, Cu and Ag layers manufactured in a manner similar to Example 1, a Se Te alloy containing 10% Te was vacuum evaporated to thickness 50 μm to form a photoconductive layer, on which PET film having a thickness of 20 μm was to form a photosensitive device according to a basic form of the present invention.

The photosensitive device was evaluated by same condition described in Example 1. The measured contrast potentials are shown in the Table 1, and are superior compared with the values of Reference 1. However, the values are less than those of Examples 1–3 which show the effect of the two layered photoconductive layer.

REFERENCE 2

On a pretreated aluminium drum, silver was directly plated by the same process described in Example 1, without inserting a Zn or a Cu layer, to a thickness of 5 μm. The photoconductive layer and the transparent insulating layer were formed as Example 1. The completed photosensitive device was evaluated as Example 1. The measured potentials are shown in Table 1. The contrast potentials are essentially similar with those of Examples 1 and 2. However, uniformity of image is not sufficient and some partial non uniformities can be recognized. As shown in Table 1, the service life is inferiority caused by contact characteristics between the layers.

TABLE 1

| | Contrast potential (Vc) | | Vc value after |
|---|---|---|---|
| | AC charging | DC charging | 50000 copies |
| Example 1 | 420 V | 540 V | 95% |
| Example 2 | 415 V | 555 V | — |
| Example 3 | 420 V | 550 V | 87% |
| Reference 1 | 70 V | 170 V | — |
| Example 4 | 330 V | 380 V | — |

TABLE 1-continued

| | Contrast potential (Vc) | | Vc value after |
|---|---|---|---|
| | AC charging | DC charging | 50000 copies |
| Reference 2 | 420 V | 540 V | 73% |

It will be appreciated that the photosensitive device according to the present invention comprises Ag conductive layer as an interface conductive layer with the selenium based photoconductive layer, and has improved charge injection characteristics during th primary charging step and also maintains the desired charge injection preventing characteristic during the simultaneous secondary charging and image exposure steps so that a high contrast and a high concentration copy image can be obtained.

The interface conductive layer of silver intimately contacts with the Al substrate conductive layer through inserted Zn conductive layer or Cu conductive layer formed on the Zn conductive layer so that uniformity and stability of the electrostatic latent image are superior and that contrast potential does not decrease substantially by repeated copy cycles so that the device has a long life.

The photosensitive device having the selenium based photoconductive layer which is formed by the charge generating layer and the charge transport layer, according to the preferred embodiment of the present invention, is formed so that generation of carrier by light exposure is allotted to the charge generating layer and transport of generated carrier and transport of injected carrier are allotted to the charge transport layer, so that photosensitivity is superior and superior image characteristic without residual potential and residual image can be obtained. Also, as the photoconductive layer is formed by selenium based evaporated film, it has very high humidity resistant property compared with conventional binder based photoconductive layer.

It is clear that the method of manufacturing a photosensitive device according to the present invention, makes it possible to easily manufacture a high quality electrophotographic photosensitive device having intimately contacted conductive layers.

In the above described embodiments, the image forming process of the photosensitive device includes simultaneous charging and image exposure steps. However, the photosensitive device of the present invention is not limited such an image forming process. For example, an image forming process including negative corona charging as a primary charging step and a simultaneous whole surface exposure step, positive corona charging step and image exposure step can be applied to the photosensitive device, according to the present invention. Also, the image forming process includes a simultaneous primary charging step and whole surface exposure step. However, since the photosensitive device according to the present invention has a superior charge injection characteristic, sufficient charge pairs can be formed across the transparent insulating layer without applying the whole surface exposure step.

What is claimed is:

1. An electrophotographic photosensitive device, comprising:

an aluminium substrate conductive layer;

a zinc conductive layer formed on the aluminium conductive layer;

a silver conductive layer formed on the zinc conductive layer;

a selenium based photoconductive layer formed on the silver conductive layer; and a transparent insulating layer formed on the photoconductive layer.

2. An electrophotographic photosensitive device, comprising:

an aluminium substrate conductive layer;

a zinc conductive layer formed on the aluminium conductive layer;

a copper conductive layer formed on the zinc conductive layer;

a silver conductive layer formed on the copper conductive layer;

a selenium based photoconductive layer formed on the silver conductive layer; and a transparent insulating layer formed on the photoconductive layer.

3. A photosensitive device according to claim 1, in which said selenium based photoconductive layer consists of:

a charge transport layer formed on said silver conductive layer and formed of either selenium or halogen doped selenium; and a charge generating layer formed on said charge transport layer and formed of a selenium and tellurium based alloy.

4. A photosensitive device according to claim 2 in which said selenium based photoconductive layer consists of:

a charge transport layer formed on said silver conductive layer and formed of either selenium or halogen doped selenium; and a charge generating layer formed on said charge transport layer and formed of a selenium and tellurium based alloy.

5. A photosensitive device according to claim 3, in which said charge transport layer consists of a selenium evaporated layer containing 0–4000 ppm halogen and having a thickness of 25–70 μm, and said charge generating layer consists of a selenium tellurium alloy evaporated layer containing 5–25% tellurium and having a thickness of 0.05–5 μm.

6. A photosensitive device according to claim 4, in which said charge transport layer consists of a selenium evaporated layer containing 0–4000 ppm halogen and having a thickness of 25–70 μm, and said charge generating layer consists of a selenium tellurium alloy evaporated layer containing 5–25% tellurium and having a thickness of 0.05–5 μm.

7. A method of manufacturing an electrophotographic photosensitive device, comprising the steps of:

forming a zinc conductive layer on an aluminium substrate conductive layer by either a substitution method or an electroplating method;

forming a silver conductive layer on the zinc conductive layer by an electroplating method;

forming a selenium based photoconductive layer on the silver conductive layer by an evaporation method; and forming a transparent insulating layer on the photoconductive layer.

8. A method of manufacturing an electrophotographic photosensitive device, comprising the steps of:

forming a zinc conductive layer on an aluminium substrate conductive layer by either a substitution method or an electroplating method;

forming a copper conductive layer on the zinc conductive layer by an electroplating method;

forming a silver conductive layer on the copper conductive layer by an electroplating method;

forming a selenium based photoconductive layer on the silver conductive layer by an evaporation method; and forming a transparent insulating layer on the photoconductive layer.

9. A method according to claim 7, in which said selenium based photoconductive layer is formed by evaporation on said silver conductive layer which is maintained at a temperature of between 55°-65° C.

10. A method according to claim 8, in which said selenium based photoconductive layer is formed by evaporation on said silver conductive layer which is maintained at temperature of between 55°-65° C.

* * * * *

UNITED STATES PATENT AND TRADEMARK OFFICE

CERTIFICATE OF CORRECTION

PATENT NO. : 4,537,846

DATED : August 27, 1985

INVENTOR(S) : Yoshiyuki Mimura et al.

It is certified that error appears in the above-identified patent and that said Letters Patent is hereby corrected as shown below:

The term of this patent subsequent to August 27, 2002 has been disclaimed.

Signed and Sealed this

*Twelfth* Day of *November 1985*

[SEAL]

*Attest:*

*Attesting Officer*

DONALD J. QUIGG

*Commissioner of Patents and Trademarks*